United States Patent [19]

Raab

[11] Patent Number: 4,877,942

[45] Date of Patent: Oct. 31, 1989

[54] THERMALLY-INSULATED CURLING IRON

[75] Inventor: John J. Raab, Brielle, N.J.

[73] Assignee: Conair Corporation, Stamford, Conn.

[21] Appl. No.: 221,207

[22] Filed: Jul. 19, 1988

[51] Int. Cl.[4] ..... H05B 1/02; A45D 1/04

[52] U.S. Cl. ..... 219/225; 132/232

[58] Field of Search ..... 219/222, 223, 224, 225, 219/226; 34/96, 97, 98, 99, 100, 101; 132/224, 227, 229, 230, 231, 232

[56] References Cited

U.S. PATENT DOCUMENTS

| | | | |
|---|---|---|---|
| 3,534,392 | 10/1970 | Trouilhet | 219/225 |
| 4,477,716 | 10/1984 | Thaler et al. | 219/225 |
| 4,602,143 | 7/1986 | Mack et al. | 219/225 |
| 4,731,519 | 3/1988 | Dieterle et al. | 219/225 |

*Primary Examiner*—A. D. Pellinen
*Assistant Examiner*—Geoffrey S. Evans
*Attorney, Agent, or Firm*—Haynes N. Johnson

[57] ABSTRACT

A curling iron which has a handle, a barrel extending axially from the handle, a heater for the barrel, a spring-pressed, pivoted spoon for holding hair against the barrel, a spoon extension formed as part of and extending outwardly from the spoon, proximate to the handle, and a thumb button at the end of the spoon extension. At least the outer surfaces of the spoon extension and the thumb button are covered with a thermally-insulating plastic material, so that these surfaces are no longer hot to the touch. The inner surfaces are preferably not insulated; this permits heat conducted from the spoon to the extension to be harmlessly radiated away inwardly.

2 Claims, 1 Drawing Sheet

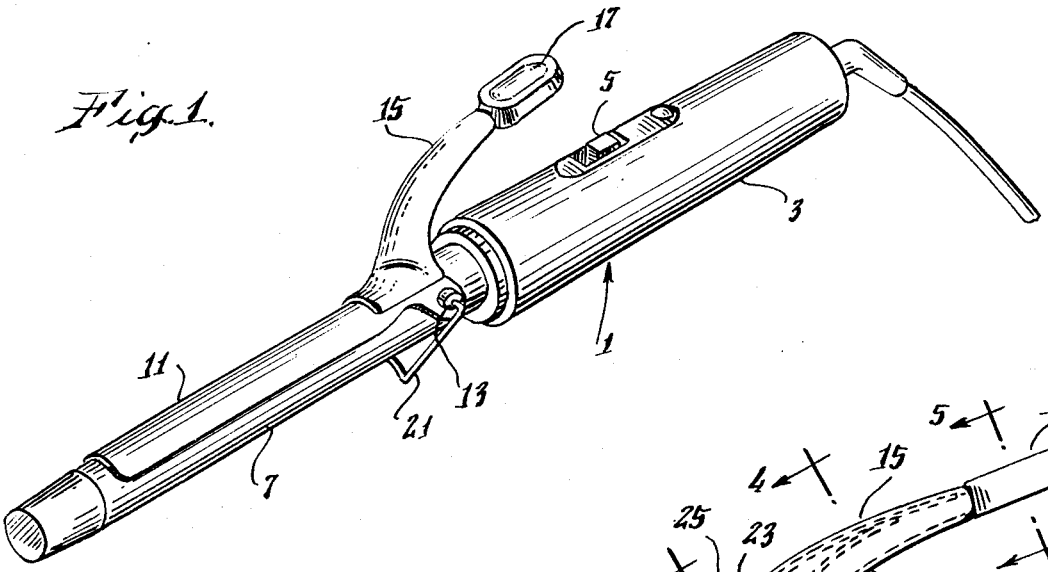
Fig. 1.
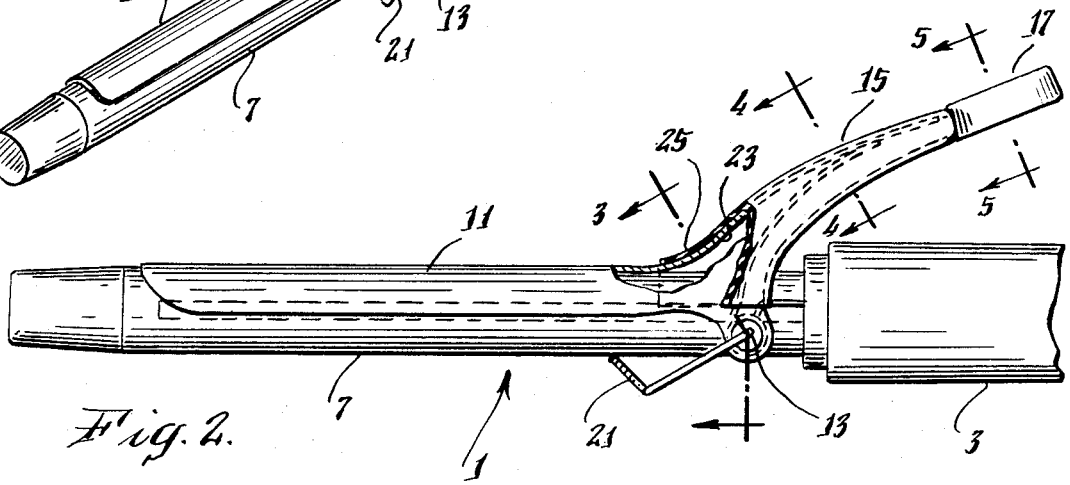
Fig. 2.
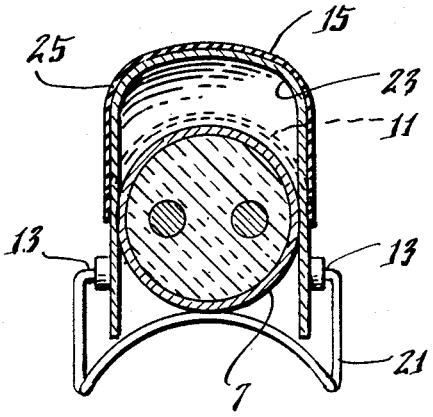
Fig. 3.
Fig. 4.
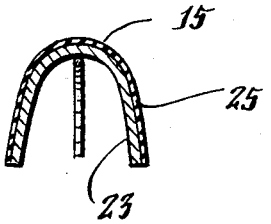
Fig. 5.
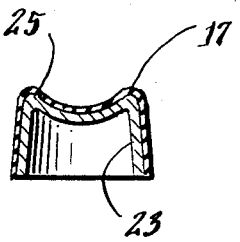

THERMALLY-INSULATED CURLING IRON

FIELD OF THE INVENTION

This application deals with personal care appliances and, in particular, curling irons.

BACKGROUND OF THE INVENTION

Curling irons have, over the years, become somewhat standardized, each having a handle, a cylindrical barrel extending from the handle, an electrical heater for the barrel, a pivoted spring-pressed spoon to hold hair against the barrel, and spoon extension used for opening the spoon.

These curling irons have also had a continuing problem: the spoon extension receives heat from the heated barrel, becomes hot itself and can be mistakenly pressed against the forehead, ears, or neck while using the iron, causing an unpleasant feeling or even burns. In spite of this, as far as can be ascertained, no one has considered thermally insulating the spoon extension. This is so, even though the outer tip of the extension, which is pressed by the thumb, has, in the past, been insulated.

BRIEF SUMMARY OF THE INVENTION

A curling iron is provided which has a handle, a barrel extending axially from the handle, a heater for the barrel, a spring-pressed, pivoted spoon for holding hair against the barrel, a spoon extension formed as part of and extending outwardly from the spoon, proximate to the handle, and a thumb button at the end of the spoon extension. At least the outer surfaces of the spoon extension and the thumb button are covered with a thermally-insulating plastic material, so that these surfaces are no longer hot to the touch. The inner surfaces of these button are preferably not insulated; this permits heat conducted from the spoon to the extension to be harmlessly dissipated by being radiated away inwardly towards the handle.

DESCRIPTION OF THE DRAWINGS

FIG. 1 is a perspective view of the curling iron of my invention.

FIG. 2 is a side elevation, partially broken away.

FIG. 3 is a section taken on line 3—3 of FIG. 2.

FIG. 4 is a section taken on line 4—4 of FIG. 2.

FIG. 5 is a section taken on line 5—5 of FIG. 2.

DETAILED DESCRIPTION OF THE INVENTION

My curling iron 1 includes a handle 3 carrying an electrical switch 5. The handle carries barrel 7 which is usually in axial alignment with the handle 3. The barrel is electrically heated in any of the customary ways (the heater is shown in dotted outline in FIG. 2).

A metallic spoon 11 fits with a complementary fit about most of the upper half of the barrel 7. It can, if desired, be shorter than the barrel. The spoon is pivotally mounted on the inner end of barrel 7 at pivot 13 and is spring-pressed against the barrel by a spring mounted about the pivot. Spoon extension 15 extends upwardly and outwardly from the barrel in the usual fashion. It is integral with the spoon 11. A thumb button 17 is at the outer end of extension 15. Extension 15 and button 17 are normally made of metal 23.

Pressure on thumb button 17 inwardly towards handle 3 serves to pivot the spoon around pivot 13 and remove it from contact with the barrel. Hair can then be wound around the barrel and the spoon released to close and hold the hair.

During the period of winding the hair around the barrel, or while the hair is being held to receive a set, users occasionally allow spoon extension 15 to touch the forehead, ears, or neck. Since extension 15 has received heat from the spoon, (in contact with heated barrel 7), such contact can be unpleasant or even cause a burn.

This problem is obviated by protecting the outer surface of extension 15 and thumb button 17 with a thermally-insulating plastic 25. See FIGS. 2 to 5. Such plastic would be a resin acceptable to Underwriters Laboratories for the temperature likely to be reached by the spoon extension and the thumb button while the spoon is against the barrel. Preferably, the plastic is about 0.060 to about 0.100 inches thick and has a coefficient of thermal expansion which is compatible with that of the extension and the button.

A typical plastic to use would be polycarbonate or high temperature polypropylene. The plastic would be molded in either one or two pieces with a shape conforming to that of the outer surface of the spoon extension and/or thumb button. If desired, additional pieces could be molded to conform to their inner surfaces. The molded plastic pieces would then be adhered to their respective surfaces adhesively, or by use of screws or boss sections.

Preferably, however, the inner surfaces of spoon extension 15 and thumb button 17 are not covered. This allows these surfaces to dissipate heat by radiating it inwardly, and harmlessly, thus tending to cool extension 15 and button 17.

I claim:

1. A thermally-insulated curling iron, said curling iron including a handle, a barrel secured to said handle, means for heating said barrel, a spoon pivotally mounted on said barrel and spring-pressed towards said barrel, said spoon having a complementary fit with at least a portion of said barrel, a spoon extension integral with said spoon and extending upwardly and outwardly from said barrel and said handle, said spoon extension having a thumb button at its outer end, the outer surface of said spoon extension being covered with thermally-insulating material, and the surface of said spoon extension facing said handle not being covered by said thermally-insulating material, whereby, though heat is conducted from said barrel to said spoon extension, said heated spoon extension is thermally-insulated from contact with one using said curling iron, and heat can be dissipated from said spoon extension by radiation in a direction away from the user.

2. In a thermally-insulated curling iron, said curling iron having a handle, a barrel secured to said handle, means for heating said barrel, and a spoon pivotally mounted on said barrel and spring-pressed towards said barrel, and a spoon extension extending upwardly and outwardly from said barrel and said handle, that improvement including the outer surface of said spoon extension being covered with thermally-insulating material, and the surface of said spoon extension facing said handle not being covered by said thermally-insulating material.

whereby, though heat is conducted from said barrel to said spoon extension, said heated spoon extension is thermally-insulated from contact with one using said curling iron, and heat can be dissipated from said spoon extension by radiation in a direction away from the user.

* * * * *